United States Patent [19]

Cutter

[11] 4,389,730

[45] Jun. 21, 1983

[54] COMPACT COLLIMATOR

[75] Inventor: James Cutter, Hollister, Calif.

[73] Assignee: Litton Industrial Products, Inc., Beverly Hills, Calif.

[21] Appl. No.: 263,448

[22] Filed: May 14, 1981

[51] Int. Cl.[3] ..... G21F 5/04; G21K 1/04

[52] U.S. Cl. ..... 378/153; 378/152

[58] Field of Search ..... 378/152, 153

[56] References Cited

U.S. PATENT DOCUMENTS 1,909,118 5/1933 Raab ..... 378/152
3,163,762 12/1964 Peyser ..... 378/153
3,947,690 3/1976 Peyser ..... 378/153
4,246,488 1/1981 Hura ..... 378/153

*Primary Examiner*—Alfred E. Smith
*Assistant Examiner*—T. N. Grigsby
*Attorney, Agent, or Firm*—John M. Haurykiewicz; Robert A. Seldon; Walter R. Thiel

[57] ABSTRACT

An X-ray collimator is disclosed having longitudinal and cross shutter assemblies disposed between an input port and an output port. Image area boundaries are defined by two pairs of inner edge portions. Mating inner edge portions of each pair move in an essentially rectilinear path.

7 Claims, 5 Drawing Figures

COMPACT COLLIMATOR

This invention relates to x-ray generating equipment and, more particularly, to collimators which operate to controllably vary the aperture through which the emerging x-rays pass.

As is known in the art, collimators are adapted for mounting to the tube housing of an x-ray generator and are positioned to receive a generally expanding conical x-ray beam via an entrance shutter. The entrance shutter is typically positioned within a recess in the tube housing that includes a transparent window to the x-ray.

X-rays are generated at a focal spot on an anode target of the tube in response to the impingement of electrons emanating from the tube cathode. Those x-rays passing through the window are referred to as "useful rays" while the remaining rays are absorbed by x-ray absorbing material, such as lead, which lines the housing.

Collimators accordingly use x-ray absorbing shutter elements to controllably vary an exit aperture and thereby variably define the beam boundaries on both the x-ray film and the patient. By limiting the cross sectional impingement area of x-rays on the patient to the area being examined, the patient is protected from a needless over-exposure to x-rays. By limiting the film exposure to sharply defined area, a plurality of adjacent images may be formed on a single piece of film.

The shutter elements are conventionally arranged as two orthogonally disposed pairs of opposingly moving plates. One pair of shutters, conveniently referred to as the "cross shutters" have aperture-defining edges which are parallel to the length of the x-ray table forming part of the overall x-ray system. The second pair of shutters, conveniently referred to as the "long shutters", have edges which are transverse to the length of the table. The "cross shutter" edges opposingly move across the table to adjust the cross-spaced image area boundaries. Similarly, the "long shutter" edges move opposingly in the longitudinal direction to adjust the longitudinally-spaced boundaries.

One concern with collimator design relates to its weight; the collimator typically hangs from an x-ray tube housing which is supported from the ceiling by an overhead support; in addition, some applications require the collimator to be oriented in a way which results in its sideways projection from the tube housing. The consequential loading of the support bearings, which permit such orientation, is a source of concern. Since the x-ray absorbing material of the collimator is typically lead, the weight of the device increases rapidly with size.

The size and weight of the collimator are also important with respect to its mobility. The inertia associated with a large collimator adversely affects the ability of the radiologist to precisely position the unit above the region to be imaged. This is particularly troublesome when compensatory movement by the patient is precluded because of pain or unconsciousness.

Size is additionally important in terms of interchangeability, in that a compact collimator may fit on the tube housings of many manufacturers within the different spaces allotted.

In addition to the foregoing design goals, cost and reliability dictate that the coupling mechanism between the shutters and the shutter-adjusting knobs or motors be as uncomplicated as possible.

In an article entitled Diagnostic X-Ray Beam Collimation (Cathode Press; Vol. 23, No. 1, pgs 36–42 (1966)), the contents of which are hereby incorporated by reference, several types of shutter elements are shown and described. In providing a background description of the art, the author describes the shutter elements' length and width as being directly proportional to their distance from the focal spot of the x-ray tube. The reference teaches that, with the shutters moving laterally across the beam, the full open shutter position establishes the collimator housing size in the direction of movement as twice the shutter size; since the shutter size is essentially the width of the x-ray beam in the plane of movement, the housing size may alternatively be described as being twice the beam width.

In order to reduce the size of the housing, the author of the foregoing reference illustrates and describes a number of alternative shutter element configurations, two of which are depicted in FIGS. 1A and 1B herewith. FIG. 1A illustrates a so-called louvered shutter mechanism including so-called "far" shutters D which are located as far from the focal spot as practical to enhance boundary definition, and intermediate shutters C. The intermediate shutters C, being located nearer to focal spot than shutters D, block the outer portion of useful radiation, thereby permitting the lateral dimension of the shutters B, D to be decreased as shown.

Although reducing the size of the collimator housing, the louvered mechanism illustrated in FIG. 1A is shown to provide a non-linear aperture adjustment; that is to say, the distance of aperture change $\Delta S$ for a given angular rotation, $\Delta\theta$, will be decreased as the shutter elements D, move inward.

A second type of shutter mechanism illustrated in the foregoing reference is shown in FIG. 1B herein. Referred to in the reference as a folding shutter, the mechanism comprises a pair of transversely and opposingly movable shutter elements F, G, each of which folds at approximately its center, as the elements move transversely outward.

While the folding shutter configuration provides the linearity lacking in the louver mechanism of FIG. 1A, it is not clear from the reference how radiation would be prevented from escaping through the fold, which is presumably a hinge arrangement. Additionally, a similar shutter arrangement in the orthogonal direction (to define the remaining exit aperture boundaries) would interfere with the movement of shutters F, G unless its plane of movement transverse to the beam was located above the uppermost reach of the outward edges of shutter F, G.

The foregoing shutter arrangement would have an adverse effect on boundary definition, however. As is known in the art, the sharpness of boundary definition increases with distance from the focal spot since the sharpest definition occurs when the blocking surface is closest to the imaged object. For this reason, and as stated in the reference, the exit shutter should be as far from the focal spot as possible. By placing the second shutter above the uppermost reach of shutters F, G boundary definition would be diminished.

In addition to the negative impact on boundary definition, the foregoing arrangement would create dissimilar linearity of movement for each shutter mechanism; the relationship ($\Delta S/\Delta\theta$) would differ significantly for the two shutter mechanisms because of the difference in distance between the respective pivot axes and the edge-defining surfaces of each mechanism. Accordingly, the adjustment mechanism would need to take the linearity differences into account resulting in complicated linkages between the adjustment knob and/or motor and the shutters.

SUMMARY OF THE INVENTION

The collimator described herein overcomes the forementioned limitations by employing two different shutter mechanisms which co-operatively reduce the required size of the collimator housing while providing an essentially linear shutter control; that is to say, that the amount of aperture change per degree of adjustment remains essentially constant throughout the span of shutter movement. Additionally, the collimator described herein provides essentially the same linearity for both shutters and a simple adjustment mechanism with resultant savings in size as well as cost.

The collimator described herein is:

adapted for mounting to an x-ray source to adjustably define the longitudinal and transverse boundaries of radiation which emerges from the source in a direction generally orthogonal to both the longitudinal and transverse directions and has a housing having an inlet port and an outlet port aligned therewith;

a first shutter assembly including a first pair of transversely narrow, longitudinally extending, x-ray absorbing shutter elements adjacent the outlet port and supported for opposing rotational movement about respective longitudinally extending axes adjacent the inlet port, the first shutter element pair having respective transversely inner, longitudinally extending edge portions which define the transverse radiation boundaries;

a second shutter assembly including a second pair of transversely extending, x-ray absorbing shutter elements oppositely adjacent the first pair with respect to the outlet port and supported for opposing rotational movement about respective transversely-extending axes adjacent the inlet port, the second pair of shutter elements having respective, longitudinally inner, transversely extending inner edge portions which define the longitudinal radiation boundaries and further include respective x-ray blocking surfaces extending longitudinally outward from the edge portions towards longitudinally-outward ends thereof;

guide means for opposingly rotating the outer ends of the blocking surfaces about the inner ends thereof as the second pair of shutter elements are rotated;

first means for opposingly rotating the first pair of shutter elements and second means for opposingly rotating the second pair of shutter elements.

Further details are shown and described in the following Description of A Preferred Embodiment of which the following drawings form a part.

DESCRIPTION OF A PREFERRED EMBODIMENT

Figure 1A:
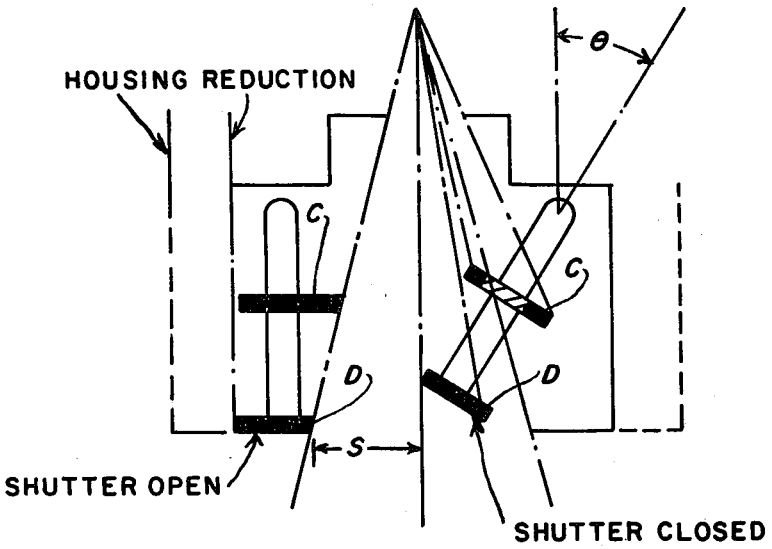
Fig 1A PRIOR ART
FIGS. 1A and 1B are schematic illustrations of shutter mechanisms known in the art.
Figure 1B:
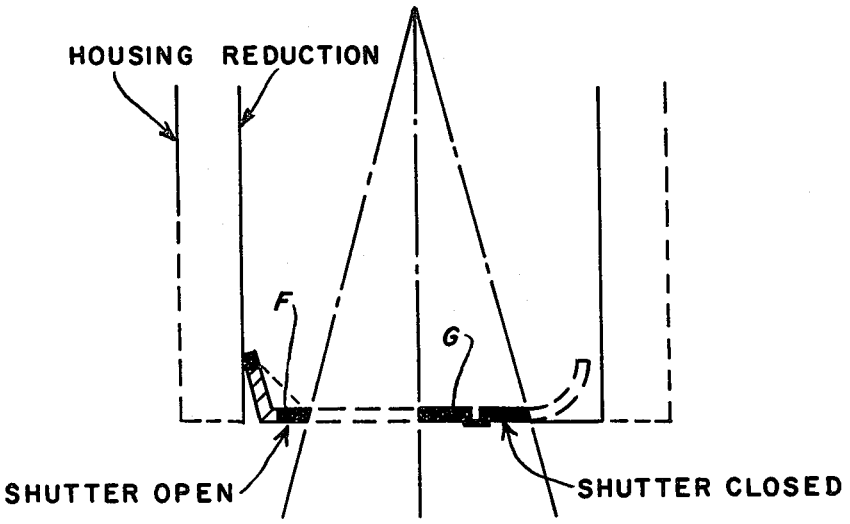
Fig 1B PRIOR ART
Figure 2:
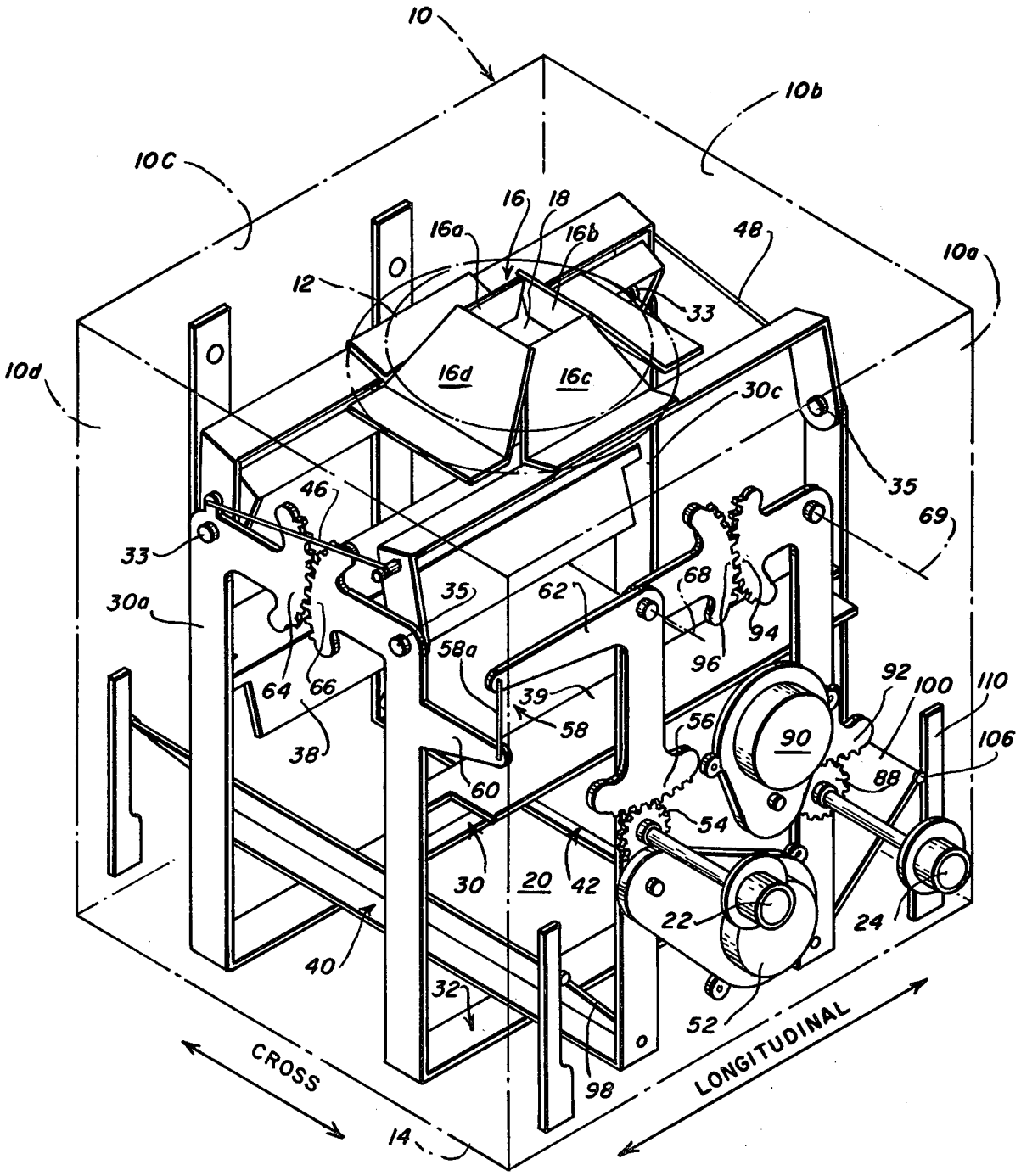
FIG. 2 is an isometric view of a preferred collimator constructed in accordance with the present invention.

Reference is initially made to FIG. 2 which is an isometric view of a collimator constructed in accordance with the invention. The collimator is shown therein to comprise a housing 10 having an entrance port 12 and an exit port 14. As is known in the art, the collimator housing is covered with x-ray absorbing material such as lead. One side wall 10*a* of the collimator is shown as providing a pair of adjustment knobs 22, 24 preferably facing the radiologist and thereby, for the purpose of this disclosure, establishing a convenient frame of reference. Accordingly, when the collimator is positioned over an x-ray table and the knobs 22, 24 are facing the radiologist, the side wall 10*a* is displaced from the opposite side wall 10*c* in the direction across the x-ray table (or "cross" direction while the side walls 10*b*, 10*d* are offset from each other in the table's longitudinal direction. The cross and longitudinal directions are therefore convenient references when describing the components of the collimator.

The entrance port 12 will be conveniently taken to be "above" the exit port 14 for the purpose of this disclosure so that the direction orthogonal to the longitudinal and cross directions can be easily referred to. It should be understood, however, that all of the directions herein are arbitrarily chosen for clarity by assuming a particular collimator orientation and that any interchanging thereof would not depart from the scope of the invention.

An entrance shutter arrangement 16 comprising four entrance shutter elements 16*a–d* protrude outward through the entrance port 12. The upper horizontal edges of the entrance shutter elements 16*a–d* define the boundaries of an entrance aperture 18. As is known in the art, the collimator housing is adapted for mounting to the tube housing of an x-ray generator so that the entrance shutter 16 is positioned within the recessed x-ray window of the tube-housing to block off-focus x-rays.

Off-focus radiation is generated in the case of a rotating anode tube by the continued emission of x-rays from portions on the anode target after they have rotated past the impinging electron beam.

Off-focus radiation is greater in the cross direction than in the longitudinal direction. For this reason, and as described hereinbelow, the shutter elements 16*a*, 16*c* which block the radiation in the cross direction are adjustable while the longitudinal shutter elements 16*b*, 16*d* may be fixed.

Directing attention to the exit port 14, there is shown an exit aperture 20 whose cross boundaries are defined by a pair of cross shutter elements 30, 32 and whose longitudinal boundaries are defined by a pair of longitudinal (or "long") shutter elements 40, 42.

Figure 3:
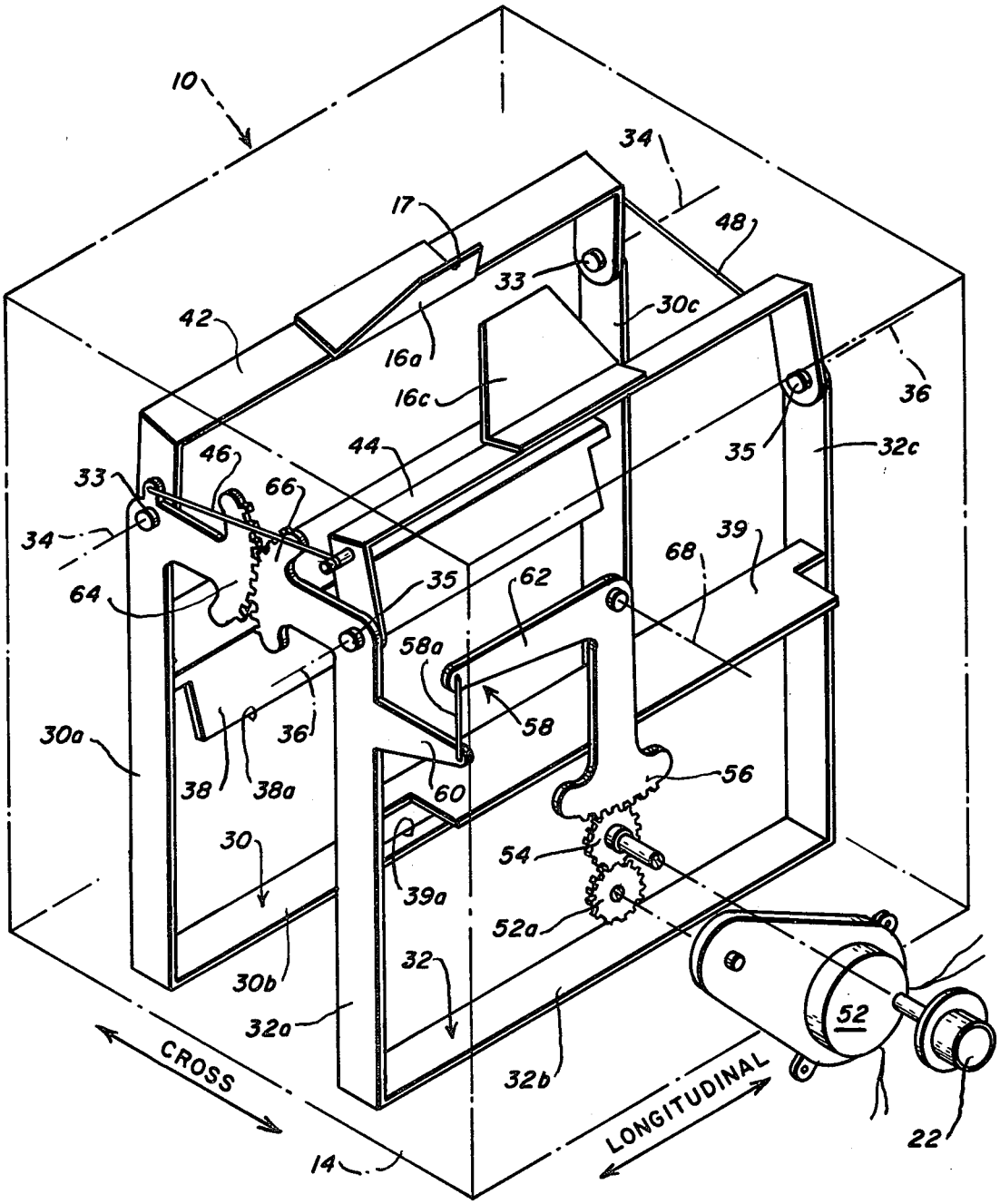
FIG. 3 is an isometric view of one of the shutter assemblies in the collimator in FIG. 1, together with a preferred mechanism for adjusting that shutter assembly.

The cross shutter assembly which includes the cross shutter elements 30, 32 is shown in FIG. 3. FIG. 3 is similar to the isometric view of FIG. 2 but illustrates only the elements of the preferred cross shutter assembly. The edge-defining portions 30*b*, 32*b* of the shutter elements 30, 32 are shown to be narrow (e.g. $\frac{3}{8}''$) transversely thin, longitudinally-extending central portions which are respectively supported by upward-extending end portions 30*a,c* and 32*a,c* for opposing pivot movement about respective longitudinally-extending axes 34, 36. The shutter elements 30, 32 are supported for pivoting movement by such means as respective pairs 33, 35 of longitudinally spaced rivets.

Also mounted for pivoting movement about axes 34, 36 are a pair of generally C-shaped entrance shutter brackets 42, 44 of width and thickness similar to the shutter elements 30, 32. Entrance shutter elements 16*a*, 16*c* are respectively affixed to the brackets 42, 44 for pivoting movement therewith.

Bracket 44 is pivotably responsive to the pivoting movement of shutter element 30 via tie rod 46. Similarly, bracket 42 is pivotably responsive to the pivoting movement of shutter element 32 via tie rod 48.

Shutter elements 30, 32 respectively include intermediate shutter elements 38, 39 of x-ray absorbing material. The intermediate shutter element 38 is located approximately midway between the entrance shutter element 16*a* and exit shutter element 30*b* and extends longitudinally between the shutter portions 30*a,c*.

The cross-section of the intermediate element 38 is generally L-shaped with the edge 38*a*, of the inner leg being aligned with the inner edge of the shutter element portion 30*b* and edge 17 of the entrance shutter 16*a*. The intermediate element 38 is securely mounted to the shutter arms 30*a,c* for pivoting movement therewith about axis 34, the alignment of the foregoing three edges being maintained.

The two legs of the intermediate element 38 thereby prevent x-rays from falling outward of the narrow edge-defining shutter portion 30*b*.

In operation, the aperture boundaries defined by the cross shutter assembly are adjusted either manually via knob 22 or electrically via motor 52. As shown in FIGS. 2 and 3, the knob 22 and a free-wheel drive gear 52*a* within the motor are both operable to rotate a driven gear 54 which, in turn, operates through an arcuate gear segment 56 of a bellcrank arrangement 58 to pivot the shutter arm 32. The bellcrank arrangement 58 is shown to comprise a tie rod 58*a* coupled at its end between a pair of vertically displaced, perpendicularly oriented projecting members 60, 62. The member 62 pivots about an axis 68. The bellcrank 58 functions to transmit the adjusting movement of gear segment 56 around the corner in the housing to the shutter arm 32 and to transform the rotational movement of the gear 54 into a pivoting movement of the arm 32 about axis 36.

The pivoting movement of shutter arm 32 is transmitted to shutter arm 30 via a pair of mating gear segments 64, 66 respectively extending from the shutter arms 30*a*, 32*a*. The gear segments 64, 66 are arcuate segments circumferentially disposed about axes 34, 36 respectively.

The pivoting movement of shutter arm 30 is coupled to the bracket 44 via a tie rod 46. Bracket 44 responsively pivots about axis 36 to move shutter element 16*c*. Similarly, bracket 42 is coupled to shutter arm 32*c* for responsive pivoting movement about axis 34 via a tie rod 48.

Figure 4:
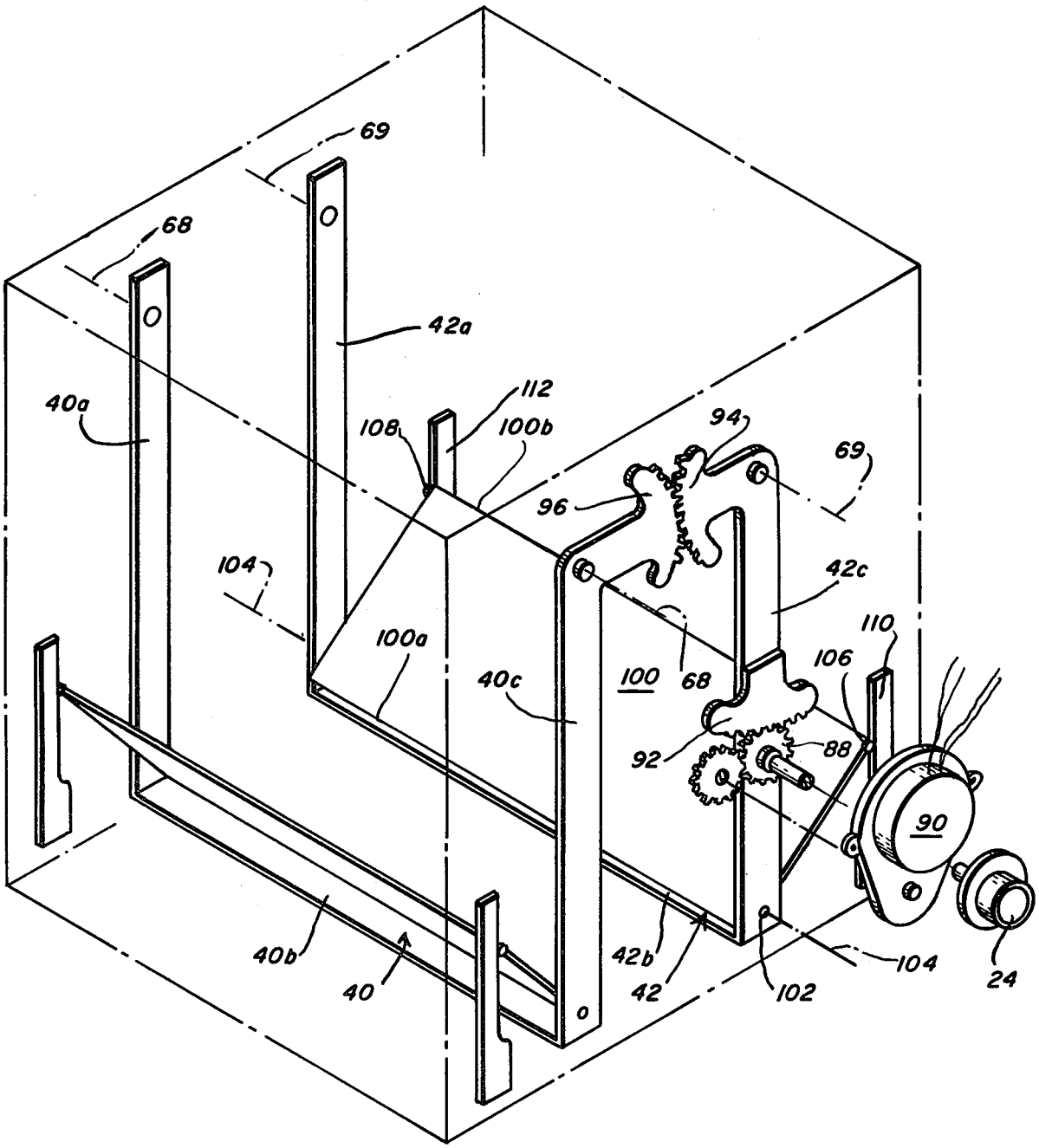
FIG. 4 is an isometric view of the second shutter assembly in the collimator shown in FIG. 1 together with a preferred mechanism for adjusting the second shutter assembly.

Having described the cross shutter mechanism, attention is turned to the longitudinal shutter mechanism illustrated in FIGS. 2 and 4. The longitudinal shutter assembly includes longitudinal shutter elements 40, 42. The edge defining portions 40*b*, 42*b* are perpendicularly oriented with respect to the cross shutter elements 30*b*, 32*b* and immediately above them, preferably ½". The edge-defining portions 40*b*, 42*b* are transversely thin elements, extending in the cross direction and are respectively supported by upward-extending end portions 40*a,c* and 41*a,c* for opposing pivotable movement about respective cross-extending axes 68, 69. As with the cross shutter assembly the longitudinal shutter elements 40, 42 are supported by such means as rivets.

As illustrated in FIGS. 2 and 4, the adjustment of the "long" shutter assembly includes a driven gear 88 which is operable by either electrical or manual means such as a motor 90 and knob 24 respectively. The driven gear 88 meshes with a arcuate segment 92 affixed to one end portion 42*c* of shutter element 42. Rotation of the driven gear 88 and the consequential pivoting of the shutter element 42 causes corresponding and opposing pivoting of shutter element 40 via arcuate gear segments 94, 96. The toothed surfaces of the gear segments 94, 96 are circumferentially disposed about axes 69, 68 respectively.

The "long" shutter elements 40, 42 include a generally planar sheet of x-ray absorbing material 98, 100 respectively. The element 100 extends in the cross direction between the end portions 42*a*, 42*c* of the shutter element 42 and is coupled for pivoting movement at its inner end 100*a* by means of a pair of rivets 102 which define a pivot axis 104. The outer edge 100*b* of the x-ray absorbing element 100 is provided with a pair of roller elements 106, 108 which respectively engage guides 110, 112.

It can be appreciated from FIGS. 2 and 4 that the planar element 100 will pivot counter clockwise about axis 104 as the shutter element 42 is moved longitudinally outward. The planar element 98, of course, operates similarly.

Because off-focus radiation in the longitudinal direction is minimal, the entrance shutter elements 16*b*, 16*d* may conveniently be fixed rather than movable with the long shutter mechanism.

Aperture adjustment by the illustrated shutter mechanisms are essentially linear for two reasons. First, the pivot arms (i.e. portions 30*a,c*, 32*a,c*, 40*a,c*, 42*a,c*) of the edge-defining elements are sufficiently long so that the translation path of the exit shutter elements are essentially straight. Stated another way, the angular variation $\Delta\theta$, experienced by the shutter arms falls within the linear portion of the tangent $\theta$ curve which correlates S to $\theta$. In the preferred embodiment, the pivot arm is approximately 4¾ inches for a translation path of 1 3/16".

Secondly, the pivot axes 34, 36, 68, 69 are located generally over the midpoint of translation to reduce non-linearities at the ends of travel. In practice, the axes are preferably located just inside the midpoint, since as a practical matter, aperture settings will usually not include the outer fringes of translation path.

It may be appreciated by those skilled in the art that the foregoing embodiment provides a compact collimator which has substantially eliminated the problems heretofore associated with the complex adjustment mechanisms. Because the x-ray absorbing material is typically lead, the reduction in size translates into a reduction of weight and, consequentially, a reduction in the loading of the x-ray tube head. The compact size is shown to result from the use of thin edge-defining elements for the cross-shutter assembly, with small intermediate shutter elements. The "long" shutter mechanism, in turn, is configured to work in close relationship with the cross mechanism without interferring with its operations.

While the foregoing Description of a Preferred Embodiment is sufficient to enable one skilled in the art to practice the invention, it is apparent that many variations and modifications are possible. Further, as previously indicated, the identification of the directions as "longitudinal", "cross", and "transverse" as well as relative positions such as "above" and "below" have been arbitrarily choosen for the sake of clarity. It is accordingly intended that the invention not be limited by these terms and that claims appended hereto be interpreted as broadly as permissible in view of the prior art so that to include all equivalents of the embodiment described herewithin:

I claim:

1. An x-ray collimator adapted for mounting to an x-ray source to adjustably define the longitudinal and transverse boundaries of radiation which emerges from the source in a direction generally orthogonal to both the longitudinal and transverse directions and comprising:

a housing having an inlet port and an outlet port aligned therewith;

a first shutter assembly including a first pair of transversely narrow, longitudinally extending, x-ray absorbing shutter elements adjacent the outlet port and supported for opposing rotational movement about respective longitudinally extending axes adjacent the inlet port, the first shutter element pair having respective transversely inner, longitudinally extending edge portions which define the transverse radiation boundaries;

a second shutter assembly including a second pair of transversely extending, x-ray absorbing shutter elements oppositely adjacent the first pair with respect to the outlet port and supported for opposing rotational movement about respective transversely-extending axes adjacent the inlet port, the second pair of shutter elements having respective, longitudinally inner, transversely extending inner edge portions which define the longitudinal radiation boundaries and further include respective x-ray blocking surfaces extending longitudinally outward from the edge portions towards longitudinally-outward ends thereof;

guide means for opposingly rotating the outer ends of the blocking surfaces about the inner ends thereof as the second pair of shutter elements are rotated;

first means for opposingly rotating the first pair of shutter elements; and second means for opposingly rotating the second pair of shutter elements.

2. The collimator of claim 1 wherein one of said first and second shutter assemblies further comprise means to permit opposingly rotational movement of one pair of said edge portions about their respective axes at a radius such that the translation paths of said edge portions are essentially straight.

3. The collimator of claim 2 wherein the axes of the first pair of shutter elements are respectively located transversely substantially midway between the ends of translation.

4. The collimator of claim 2 wherein the axes of the second pair of shutter elements are respectively located longitudinally substantially midway between the ends of translation.

5. The collimator of claim 2 wherein the axes of the edge portions of a pair of shutter elements are located apart a distance equal to or less than one-half the length of maximum translation of that pair of shutter elements.

6. The collimator of claim 2 wherein the rotational axes of one pair are spaced a distance from the outlet port substantially greater than twice the length of maximum translation of the respective edge portions of that pair.

7. The collimator of claim 6 wherein said distance is substantially four times the length of said maximum translation.

* * * * *